US012359877B2

(12) United States Patent
Pflomm et al.

(10) Patent No.: US 12,359,877 B2
(45) Date of Patent: Jul. 15, 2025

(54) REFRIGERATION APPLIANCE

(71) Applicant: BSH Hausgeräte GmbH, Munich (DE)

(72) Inventors: Berthold Pflomm, Ulm (DE); Andreas Vogl, Haunsheim (DE); Ming Zhang, Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 250 days.

(21) Appl. No.: 18/028,071

(22) PCT Filed: Sep. 14, 2021

(86) PCT No.: PCT/EP2021/075187
§ 371 (c)(1),
(2) Date: Mar. 23, 2023

(87) PCT Pub. No.: WO2022/063634
PCT Pub. Date: Mar. 31, 2022

(65) Prior Publication Data

US 2023/0332840 A1 Oct. 19, 2023

(30) Foreign Application Priority Data

Sep. 28, 2020 (DE) ..... 10 2020 212 203.2

(51) Int. Cl.
*F28D 15/04* (2006.01)
*F25B 41/37* (2021.01)
(Continued)

(52) U.S. Cl.
CPC ..... *F28D 15/043* (2013.01); *F25B 41/37* (2021.01); *F25B 41/39* (2021.01); *F25B 5/04* (2013.01);
(Continued)

(58) Field of Classification Search
CPC ..... F25B 41/20; F25B 41/37; F25B 41/39; F25B 43/003; F25B 2341/062;
(Continued)

(56) References Cited

U.S. PATENT DOCUMENTS 6,253,561 B1 * 7/2001 Imakubo ..... F25B 5/04 62/158
6,327,871 B1 * 12/2001 Rafalovich ..... F25B 5/04 62/434
(Continued)

FOREIGN PATENT DOCUMENTS

CN 108168131 A 6/2018
DE 602004010153 T2 10/2008
(Continued)

*Primary Examiner* — Joseph F Trpisovsky
(74) *Attorney, Agent, or Firm* — Laurence A. Greenberg; Werner H. Stemer; Ralph E. Locher

(57) ABSTRACT

A refrigeration appliance, in particular a domestic refrigeration appliance, has at least one refrigeration compartment for accommodating refrigerated goods and a refrigerant circuit. The refrigerant circuit has a condenser, an evaporator for cooling the refrigeration compartment, the evaporator being thermally coupled to the at least one refrigeration compartment and connected to the condenser, a dryer, which is arranged between the condenser and the evaporator, and a valve device, which is connected by an intermediate capillary tube to the dryer and by a throttle capillary tube to the evaporator.

16 Claims, 2 Drawing Sheets

(51) Int. Cl.

| | |
|---|---|
| ***F25B 41/39*** | (2021.01) |
| *F25B 5/04* | (2006.01) |
| *F25B 43/00* | (2006.01) |

(52) U.S. Cl.
CPC ..... *F25B 43/003* (2013.01); *F25B 2600/2507* (2013.01)

(58) Field of Classification Search
CPC ..... F25B 2400/052; F25B 2400/054; F25B 2600/2507; F25B 5/04; F28D 15/043
See application file for complete search history.

(56) References Cited

U.S. PATENT DOCUMENTS

| | | | | |
|---|---|---|---|---|
| 7,340,920 | B2 | 3/2008 | Zimmermann | |
| 2005/0150248 | A1* | 7/2005 | Manole | F25B 40/00 62/513 |
| 2006/0032267 | A1 | 2/2006 | Kamimura et al. | |
| 2012/0047924 | A1 | 3/2012 | Li | |
| 2015/0096325 | A1* | 4/2015 | Rivis | F25B 41/37 62/511 |

FOREIGN PATENT DOCUMENTS

| | | | |
|---|---|---|---|
| DE | 102015219324 | A1 | 4/2017 |
| DE | 102015221441 | A1 | 5/2017 |
| WO | 2015194891 | A1 | 12/2015 |

* cited by examiner

REFRIGERATION APPLIANCE

FIELD AND BACKGROUND OF THE INVENTION

The present invention relates to a refrigeration appliance, in particular a household refrigeration appliance, such as a refrigerator, an upright freezer or a fridge-freezer.

PRIOR ART

In refrigeration appliances, in particular in household refrigeration appliances such as refrigerators, upright freezers or fridge-freezers, a refrigeration circuit is provided which typically has a refrigerant compressor, a condenser, a throttle, an evaporator and a feedback line. The throttle is generally designed as a capillary tube which connects an output of the condenser with an input of the evaporator. In order to avoid an inflow of refrigerant into the evaporator when the compressor is switched off, a valve is generally provided, which is arranged between an input of the capillary tube and a connecting pipe which is connected to the output of the condenser.

DE 60 2004 010 153 T2 discloses a refrigeration appliance with a refrigeration circuit, in which a capillary tube is split between the condenser and evaporator. In this regard a first capillary tube is connected to an output of a connecting pipe connected to the condenser and an input of a collecting container and a second capillary tube connects an output of the collecting container with an input of the evaporator. A feedback line from the condenser to a compressor is in heat-conducting contact with the capillary tubes and the collecting container. The objective of this design is to undercool the coolant in the region of the output of the collecting container in order to simplify a volumetric flow control.

CN 108168131 A discloses a refrigeration appliance with a combined throttle apparatus which has a first capillary tube, an air-cooled intercooler and a second capillary tube, wherein a feedback line from an evaporator to a compressor achieves an exchange of heat by way of the air-cooled intercooler. This design is used for the purpose of reducing noise owing to fluctuations in the refrigerant when leaving the throttle apparatus.

DE 10 2015 221 441 A1 further discloses a refrigeration appliance with two capillary tube groups arranged in series, wherein the first capillary tube group is arranged between a first valve and a second valve. By switching the valves, different flow paths can be realized with different throttle effects in order to vary a flow rate.

In general, the capillary tubes are designed so that a desired throttle effect of the refrigerant or a predetermined flow rate is achieved. This may then result in the capillary tube having a large length if only minimal flow resistances exist upstream of the capillary tube, which is essentially desirable.

SUMMARY OF THE INVENTION

One of the objects of the present invention is to provide improved solutions for the configuration of a throttle in refrigeration appliances.

This object is achieved according to the invention by a refrigeration appliance having the features of the independent refrigeration appliance claim.

In accordance with the invention, a refrigeration appliance, in particular a household refrigeration appliance, such as a refrigerator, an upright freezer or a fridge-freezer is provided. The refrigeration appliance comprises at least one refrigeration compartment for receiving refrigerated goods and a refrigerant circuit with a condenser, an evaporator coupled thermally to the at least one refrigeration compartment for cooling the refrigeration compartment, which is connected to the condenser, a dryer arranged between the condenser and the evaporator and a valve facility, which is connected to the dryer by an intermediate capillary tube and to the evaporator by a throttle capillary tube.

One idea underlying the invention is to achieve a throttle effect, which is to be achieved between a condenser and an evaporator of the refrigeration appliance, by means of separate capillary tubes connected in series. To this end provision is made for an intermediate capillary tube, which connects a dryer, arranged downstream of the condenser, to a valve facility, and a throttle capillary tube, which connects the valve facility to the evaporator. Part of the desired throttle effect is therefore already achieved upstream of the valve facility by the intermediate capillary tube, e.g. approximately one third of the desired pressure difference to be achieved. The dryer is designed to extract water from the refrigerant originating from the condenser. By arranging the intermediate capillaries downstream of the dryer, a throttling of the refrigerant is advantageously avoided before it passes through the dryer.

One advantage of the inventive configuration with the intermediate capillary tube lies in the fact that the throttle valve tube, which brings about the remaining desired throttle effect up to the evaporator, can be shortened. This may then result in the capillary tube length being shortened overall, which results in material and thus cost savings.

One further advantage lies in the space-saving configuration of the refrigerant circuit. For instance, the intermediate capillary tube can run completely within a machine room of the refrigeration appliance, in which a compressor and the valve facility are arranged, for instance.

Advantageous embodiments and developments result from the subclaims relating back to the independent claims in conjunction with the description.

According to some embodiments, provision can be made for the intermediate capillary tube to be connected directly to an output of the dryer. Alternatively to this, an output of the dryer can be connected to an evacuation tube, wherein the intermediate capillary tube leads out from the evacuation tube. In general, the intermediate capillary tube can therefore be connected directly to an output of the dryer or an intermediate piece connected to the output of the dryer can be connected. The direct connection of the intermediate capillaries to the dryer is advantageous in that a structurally simple design is achieved. By connecting the intermediate capillaries and the evacuation tube, a highly functional integration is advantageously achieved.

According to some embodiments, provision can be made for the intermediate capillary tube to pass uninterrupted between the output of the dryer and an input of the valve facility or uninterrupted between the evacuation tube and the input of the valve facility. The intermediate capillary tube itself is therefore preferably no longer divided. As a result, a continuous throttling of the refrigerant is achieved along the intermediate capillaries, as a result of which flow noises are further reduced.

According to some embodiments, provision can be made for the intermediate capillary tube to have a length in a range of between 0.3 m and 1.0 m. Further optionally, the intermediate capillary tube can have a length in a range of between 0.6 m and 0.9 m.

According to some embodiments, provision can be made for the intermediate capillary tube to have an internal diameter in a range of between 0.55 mm and 0.8 mm. In this range, a good throttling effect is achieved for typical flow rates, e.g. in a range of between 150 l/h and 300 l/h.

According to some embodiments, provision can be made for the refrigeration appliance to have a first refrigeration compartment and a second refrigeration compartment, wherein the refrigerant circuit has a first evaporator coupled thermally to the first refrigeration compartment and a second evaporator coupled thermally to the second refrigeration compartment, wherein an input of the first evaporator is connected to the valve facility by means of a first throttle capillary tube, and wherein an input of the second evaporator is connected to the valve facility by means of a second throttle capillary tube. Accordingly, a refrigeration appliance with different partial refrigerant circuits can be easily realized. The different refrigeration compartments can optionally be cooled by the evaporator to different temperatures.

According to some embodiments, provision can be made for an output of the first evaporator to be connected to the input of the second evaporator. In this way the energy efficiency of the refrigeration appliance can be further improved.

According to some embodiments, provision can be made for the first refrigeration compartment to be a refrigerator compartment and the second refrigeration compartment to be a freezer compartment. For instance, the first evaporator can be designed to cool the refrigerator compartment to a temperature in a range of between −1° C. and 15° C. For instance, the second evaporator can be designed to cool the freezer compartment to a temperature in a range of between −30° C. and 0° C.

According to some embodiments, provision can be made for the valve facility to be embodied to optionally connect the intermediate capillary tube to the first throttle capillary tube or the second throttle capillary tube in a fluidically conducting manner. The valve facility can have the function of a directional valve, as a result of which a flow rate of refrigerant through the different evaporators can be varied in a flexible manner.

According to some embodiments, provision can be made for the valve facility to be embodied to interrupt a flow from the intermediate capillary tube into the throttle capillary tube. The valve facility can accordingly have the function of a non-return valve, as a result of which a supply of refrigerant into the at least one evaporator is avoided, when a compressor of the refrigerant circuit is switched off.

According to some embodiments, provision can be made for the valve facility to be realized as a rotary valve, which is embodied to separate the intermediate capillary tube optionally fluidically from the first and the second throttle capillary tube, and to connect to the first throttle capillary tube or to the second throttle capillary tube in a fluidically conducting manner. Accordingly, the function of the non-return valve and the directional valve can advantageously be combined in one single component.

According to other embodiments, provision can also be made for the valve facility to have a non-return valve and a distributor valve connected in series herewith, wherein the non-return valve is embodied to separate the intermediate capillary tube fluidically from the first and the second throttle capillary tube, and wherein the distributor valve is embodied to connect the intermediate capillary tube optionally to the first throttle capillary tube or to the second throttle capillary tube in a fluidically conducting manner.

According to some embodiments, provision can be made for the throttle capillary tube to have a length in a range of between 2.00 m and 3.25 m. The length of the throttle capillary tube can therefore be significantly reduced by the intermediate capillary tube. If a first and a second throttle capillary tube are provided, the length of the first throttle capillary tube can lie for instance in a range of between 3.0 m and 2.0 m and the length of the second throttle capillary tube can lie in a range of between 3.1 m and 2.0 m for instance.

According to some embodiments, provision can be made for the throttle capillary tube to have an internal diameter in a range of between 0.55 mm and 0.8 mm. The intermediate capillary tube and the throttle capillary tube preferably have the same internal diameter. If a first and a second throttle capillary tube are provided, the first and/or the second throttle capillary tube can optionally have an internal diameter which is identical to the internal diameter of the intermediate capillary tube. This further facilitates the design of the refrigerant circuit.

More generally, the refrigerant circuit can have a compressor, which is designed to convey refrigerant through the condenser, the dryer and the evaporator or evaporators. The compressor can be arranged in particular between an input of the condenser and an output of the evaporator, in particular of the second evaporator.

BRIEF DESCRIPTION OF THE DRAWINGS

The invention is explained in more detail below with reference to the figures of the drawings. In the figures.

In the figures, identical reference characters refer to identical or functionally identical components, unless the opposite is specified.

DETAILED DESCRIPTION OF THE INVENTION

Figure 1:
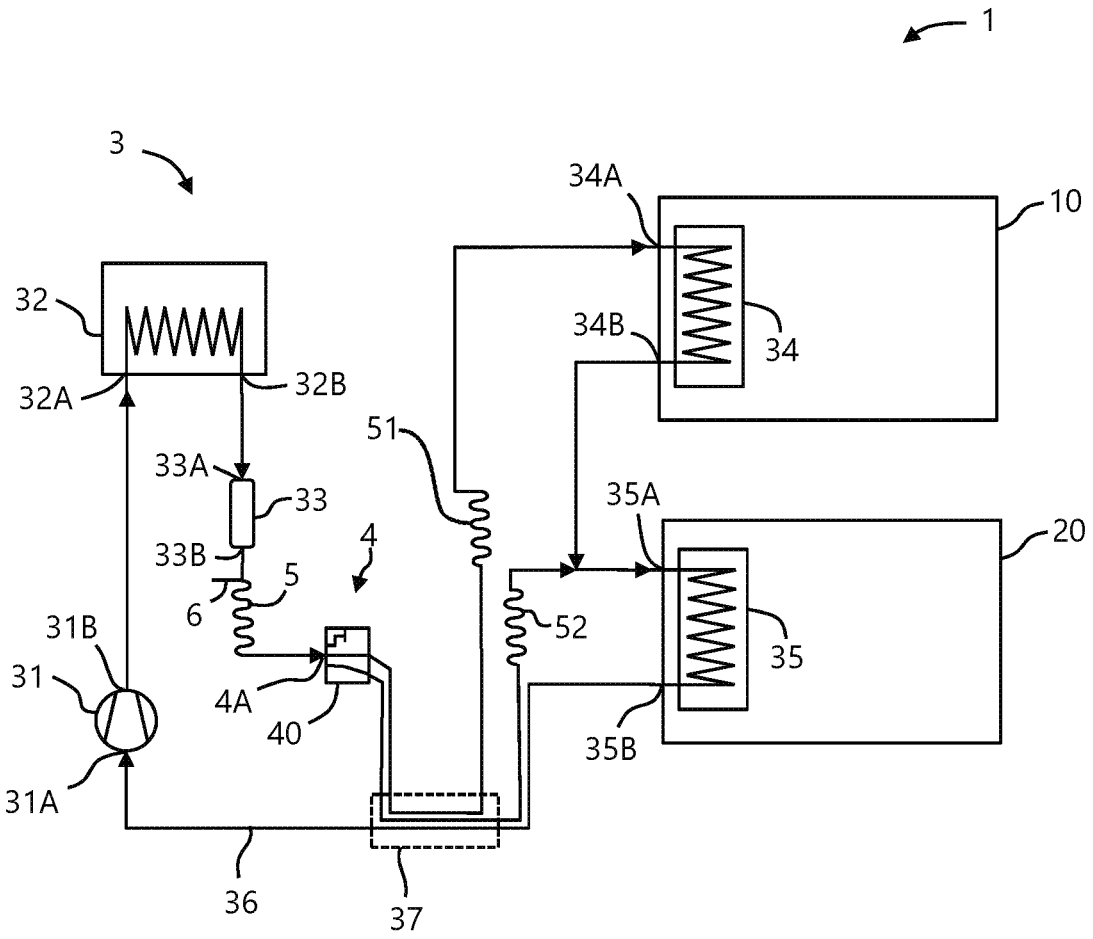
FIG. 1 shows a schematic representation of a block diagram of a refrigeration appliance according to an exemplary embodiment of the invention.

FIG. 1 shows by way of example a block diagram of a refrigeration appliance 1. The refrigeration appliance 1 can be in particular a household refrigeration appliance, e.g. a refrigerator, an upright freezer or a chest freezer or a fridge-freezer.

The refrigeration appliance 1 shown by way of example in FIG. 1 comprises a first refrigeration compartment 10, a second refrigeration compartment 20 and a refrigerant circuit 3, which is embodied to extract heat from the refrigeration compartments 10, 20 and to output the same into the environment. It is basically also conceivable for the refrigeration appliance 1 to have just one refrigeration compartment or more than two refrigeration compartments. In general the refrigeration appliance 1 therefore comprises at least one refrigeration compartment.

The first refrigeration compartment 10 can be a refrigerator compartment, for instance. In this case, the refrigerant circuit 3 can be embodied to cool the refrigerator compartment to a temperature in a range of between −1° C. and 15° C. The second refrigeration compartment 20 can be for instance a freezer compartment, wherein the refrigerant circuit 3 can be embodied to cool the freezer compartment to a temperature in a range of between −30° C. and 0° C. The refrigeration compartments 10, 20 can naturally also be both refrigerator or freezer compartments. In general the refrigeration compartments 10, 20 are containers which are spatially separated from one another or spatially different zones within a container, from which heat can be extracted by means of an evaporator 34, 35. The refrigeration compartments 10, 20 can therefore be cooled to the same or different temperatures.

As shown by way of example in FIG. 1, the refrigerant circuit 3 can have a compressor 31, a condenser 32, a dryer 33, an intermediate capillary 5, a valve facility 4, one or more connecting capillaries 51, 52 and at least one evaporator 34, 35.

The compressor 31 is embodied to circulate refrigerant, e.g. R600a, in the refrigeration circuit 3. As shown schematically in FIG. 1, an output or a pressure 11 side 33B of the compressor 31 is connected to an input 32A of the condenser 32. The condenser 32 is realized as a heat exchanger, e.g. as a plate-fin heat exchanger or as what is known as a "Tube-on-Sheet heat exchanger", abbreviated to "ToS heat exchanger", and is embodied to condense gaseous refrigerant by exchanging heat with the environment.

As shown again schematically in FIG. 1, an input 33A of the dryer 33 is connected to an output 32B of the condenser 32. The dryer 33 is embodied to extract water from the refrigerant. As shown by way of example in FIG. 1, an optional evacuation tube 6 can be connected to an output 33B of the dryer 33. Before filling with refrigerant the refrigerant circuit 3 can be evacuated by way of the evacuation tube 6. Instead of the evacuation tube 6, another intermediate piece, e.g. a pipe section, can also be connected to the output 33B of the dryer 33.

As shown by way of example in FIG. 1, an input 4A of the valve facility 4 can be connected to the dryer 33 by means of the intermediate capillaries 5 in a fluidically conducting manner. With the refrigerant circuit 3 shown by way of example in FIG. 1, the intermediate capillary tube 5 leads out from the evacuation tube 6. In general, the intermediate capillary tube 5 can therefore be connected to the intermediate piece. The intermediate capillary tube 5 therefore connects the dryer and the valve facility 4. In particular, the intermediate capillary tube 5 can pass uninterrupted between the intermediate piece and the input 4A of the valve facility 4, as shown by way of example in FIG. 1, in particular without further hydraulic components or heat exchange components being provided between the intermediate piece and the valve facility 4. The intermediate capillary tube 5 can have a length in a range of between 0.3 m and 1.0 m, for instance. For instance, the intermediate capillary tube 5 can extend within a machine room of the refrigeration appliance 1, in which the compressor 31, an optional condensed 7 water tray (not shown) for receiving condensed water from the at least one refrigeration compartment 10, 20, the dryer 33 and the valve facility 4 is received. For instance, provision can be made for the valve facility 4 and the dryer 33 to be arranged at opposite end or edge regions of the machine room. An internal diameter of the intermediate capillary tube 5 can lie for instance in a range of between 0.55 mm and 0.8 mm. The intermediate capillary tube 5 is preferably formed from copper.

As furthermore shown schematically and by way of example in FIG. 1, the first evaporator 34 is connected to the valve facility 4 by means of a first throttle capillary tube 51 and the second evaporator 35 is connected to the valve facility 4 by means of a second throttle capillary tube 52. As already explained, it is however also conceivable for only one refrigeration compartment and an evaporator to be provided, which is connected to the valve facility 4 by means of a throttle capillary tube. For instance, provision can however also be made for each evaporator to be connected to the valve facility 4 by way of a throttle capillary tube in each case. Alternatively, even with a plurality of evaporators, only a first evaporator can be connected to the valve facility 4 by way of a throttle capillary tube, while the further evaporator or evaporators are connected in series with the first evaporator. FIG. 1 shows by way of example that the first throttle capillary tube 51 is connected to an input 34A of the first evaporator 34 and the second throttle capillary tube 52 is connected to an input 35A of the second evaporator 34. An output 34B of the first evaporator 34 can further be connected to the input 35A of the second evaporator 35, as shown by way of example in FIG. 1. An output 35B of the second evaporator 35 is connected to an input or a suction side 31A of the evaporator 31, e.g. by way of a suction tube 36. As also shown by way of example and only schematically in FIG. 1, the throttle capillary tubes 51, 52 can run at least in sections in heat-conducting contact with the suction tube 36, e.g. be connected herewith, so that a suction throttle tube heat exchanger 37 is embodied.

The first throttle capillary tube 51 and/or the second throttle capillary tube 52 can have a length in a range of between 2.00 m and 3.25 m, for instance. An internal diameter of the first throttle capillary tube 51 and/or of the second throttle capillary tube 52 can lie in a range of between 0.55 mm and 0.8 mm for instance. Provision can optionally be made for the intermediate capillary tube 5 and the first and/or the second throttle capillary tube 51, 52 to have the same internal diameter. The first throttle capillary tube 51 and/or the second throttle capillary tube 52 can be formed from copper, for instance.

The valve facility 4 can be realized as a rotary valve 40, as shown by way of example in FIG. 1. In this case, the valve facility 4 can be embodied on the one hand to block the flow of refrigerant from the intermediate capillary tube 5 into the first and the second throttle capillary tube 5, e.g. when the compressor is stationary. Furthermore, the valve facility 4 can be embodied to connect the intermediate capillary tube 5 optionally to the first throttle capillary tube 51 or the second throttle capillary tube 52 in a fluidically conducting manner in order to conduct refrigerant by way of the first throttle capillary tube 51 into the first evaporator 34 or by way of the second throttle capillary tube 52 into the second evaporator 35.

Figure 2:
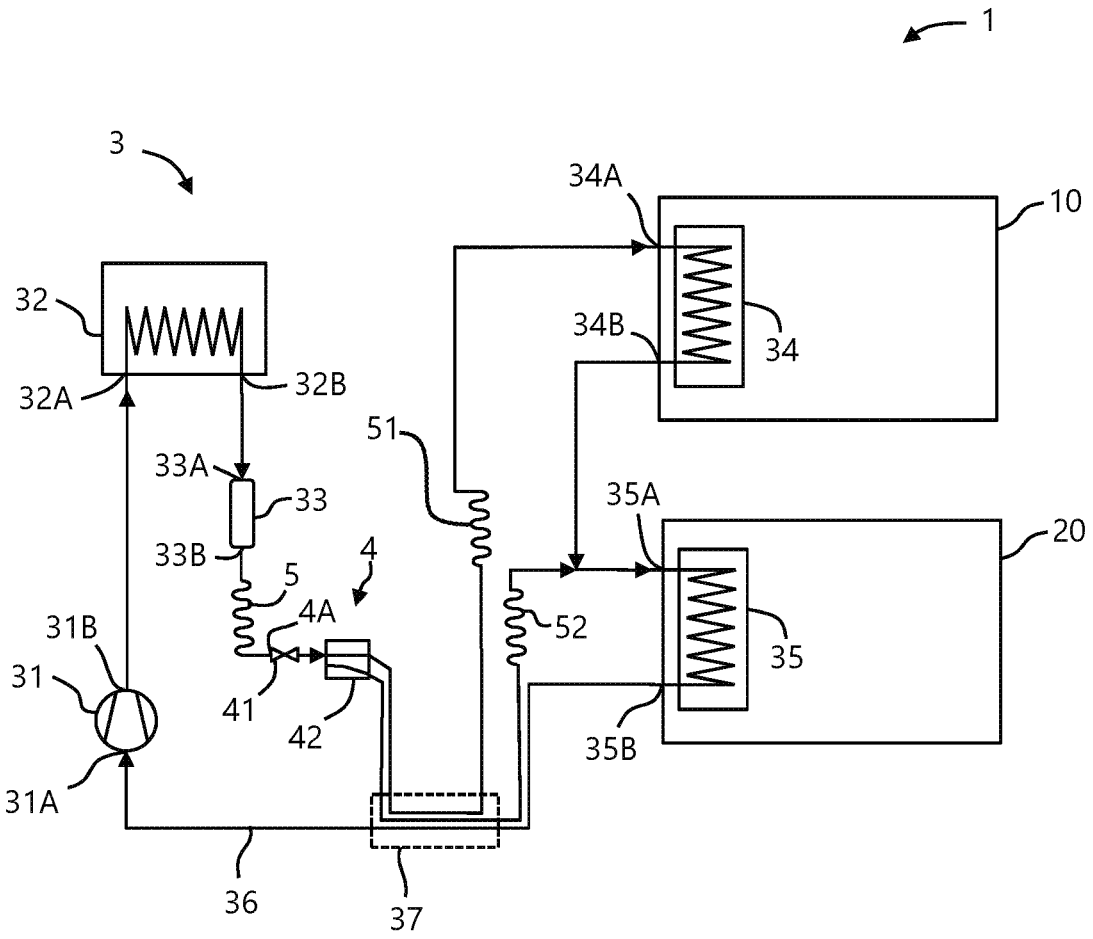
FIG. 2 shows a schematic representation of a block diagram of a refrigeration appliance according to a further exemplary embodiment of the invention.

The refrigeration appliance 1 shown by way of example in FIG. 2 differs from the refrigeration appliance 1 shown in FIG. 1 by the design of the valve facility 4 and by the connection of the intermediate capillary tube 5 to the dryer 33. Reference is therefore made to the above description in order to avoid repetitions.

As FIG. 2 shows by way of example, the intermediate capillary tube 5 can connect directly, in particular without an intermediate piece, to the output 33A of the dryer 33. The intermediate capillary tube 5 in this case optionally runs uninterrupted between the output 33A of the dryer 33 and the input 4A of the valve facility 4.

With the refrigeration appliance 1 shown by way of example in FIG. 2, the valve facility 4 is realized by two separate valves. In particular, the valve facility 4 can have a non-return valve 41 and a distributor valve 42 connected in series herewith. As shown by way of example in FIG. 2, the non-return valve 41 can be arranged between the intermediate capillary tube 5 and the distributor valve 42.

The non-return valve 41 can be embodied in particular to fluidically separate the intermediate capillary tube 5 from the first and the second throttle capillary tube 51, 52. The valve facility 4 is therefore embodied to interrupt a flow from the intermediate capillary tube 5 into the throttle capillary tube 51, 52, e.g. when the compressor 31 is stationary.

The distributor valve 42 forms a directional valve which is embodied to connect the intermediate capillary tube 5 optionally to the first throttle capillary tube 51 or to the second throttle capillary tube 52 in a fluidically conducting manner in order to conduct refrigerant by way of the first throttle capillary tube 51 into the first evaporator 34 or by way of the second throttle capillary tube 52 into the second evaporator 35. The valve facility 4 is therefore embodied to connect the intermediate capillary tube 5 optionally to the first throttle capillary tube 51 or the second throttle capillary tube 52 in a fluidically conducting manner.

By means of the above-described design of the refrigeration appliances 1 shown in FIGS. 1 and 2 with an intermediate capillary tube 5, which connects the dryer 33 and the valve facility 4, and an additional throttle capillary tube 51, 52, which connects the valve facility 4 to a respective evaporator 34, 35, a throttling of the refrigerant, e.g. of R600a, is divided between a region upstream and a region downstream of the valve facility 4. For instance, when a predetermined amount of pressure is to be reduced between the output 33B of the dryer 33 and an input 34A, 34B of the respective evaporator 34, 35, the intermediate capillary tube 5 can be designed, in particular its internal diameter and its length, so that 25 percent to 40 percent of the predetermined amount of pressure is reduced in the intermediate capillary tube 5. By dividing the reduction in pressure between the intermediate capillaries 5 and the throttle capillary tube or tubes 51, 52, the length of the throttle capillary tubes 51, 52 can be significantly reduced. A space-saving installation of the throttle capillary tubes 51, 52 is therefore facilitated on the one hand. Furthermore, as a result, material can advantageously be saved. 2

Although the present invention was explained by way of example above on the basis of exemplary embodiments, it is not restricted thereto but can be modified in a variety of ways. In particular, combinations of the preceding exemplary embodiments are also conceivable. For instance, with the refrigeration appliance 1 shown in FIG. 2, the valve facility 4 can be embodied as a rotary valve 40.

REFERENCE CHARACTERS

1 Refrigeration appliance
3 Refrigerant circuit
4 Valve facility
4A Input of the valve facility
5 Intermediate capillary tube
10 First refrigeration compartment/refrigerator compartment
20 Second refrigeration compartment/freezer compartment
31 Compressor
31A Input of the compressor
31A Output of the compressor
32 Condenser
32A Input of the condenser
32B Output of the condenser
33 Dryer
33A Input of the dryer
33B Output of the dryer
34 First evaporator
34A Input of the first evaporator
34B Output of the first evaporator
35 Second evaporator
35A Input of the second evaporator
35B Output of the second evaporator
36 Suction tube
37 Suction throttle tube heat exchanger
40 Rotary valve
41 Non-return valve
42 Distributor valve
51 First throttle capillary tube
52 Second throttle capillary tube

The invention claimed is:

1. A refrigeration appliance, comprising:
at least one refrigeration compartment for receiving refrigerated goods; and
a refrigerant circuit, containing:
a condenser;
an evaporator coupled thermally to said at least one refrigeration compartment for cooling said at least one refrigeration compartment, said evaporator being connected to said condenser;
a dryer disposed between said condenser and said evaporator;
a throttle capillary tube;
an intermediate capillary tube; and
a valve facility being connected to said dryer by means of said intermediate capillary tube and to said evaporator by means of said throttle capillary tube; and
said dryer having an output, said intermediate capillary tube being connected directly to said output of said dryer
said valve facility having an input; and
said intermediate capillary tube running uninterrupted between said output of said dryer and said input of said valve facility.

2. The refrigeration appliance according to claim 1,
further comprising an intermediate piece; and
wherein said dryer has an output connected to said intermediate piece.

3. The refrigeration appliance according to claim 1, wherein said intermediate capillary tube has a length in a range of between 0.3 m and 1.0 m.

4. The refrigeration appliance according to claim 1, wherein said intermediate capillary tube has an internal diameter in a range of between 0.55 mm and 0.8 mm.

5. The refrigeration appliance according to claim 1, wherein said throttle capillary tube has a length in a range of between 2.00 m and 3.25 m.

6. The refrigeration appliance according to claim 1, wherein said throttle capillary tube has an internal diameter in a range of between 0.55 mm and 0.8 mm.

7. The refrigeration appliance according to claim 1, wherein the refrigeration appliance is a household refrigeration appliance.

8. A refrigeration appliance, comprising:
at least one refrigeration compartment for receiving refrigerated goods; and
a refrigerant circuit, containing:
a condenser;
an evaporator coupled thermally to said at least one refrigeration compartment for cooling said at least one refrigeration compartment, said evaporator being connected to said condenser;
a dryer disposed between said condenser and said evaporator;
a throttle capillary tube;
an intermediate capillary tube; and a valve facility being connected to said dryer by means of said intermediate capillary tube and to said evaporator by means of said throttle capillary tube;

said at least one refrigeration compartment including a first refrigeration compartment and a second refrigeration compartment;

said throttle capillary tube including a first throttle capillary tube and a second throttle capillary tube; and said evaporator including a first evaporator having an input and a second evaporator having an input, said first evaporator is coupled thermally to said first refrigeration compartment and said second evaporator is coupled thermally to said second refrigeration compartment, wherein said input of said first evaporator is connected to said valve facility by means of said first throttle capillary tube and wherein said input of said second evaporator is connected to said valve facility by means of said second throttle capillary tube.

9. The refrigeration appliance according to claim 8, wherein said first evaporator has an output connected to said input of said second evaporator.

10. The refrigeration appliance according to claim 8, wherein said first refrigeration compartment is a refrigerator compartment and said second refrigeration compartment is a freezer compartment.

11. The refrigeration appliance according to claim 8, wherein said valve facility is embodied to connect said intermediate capillary tube to said first throttle capillary tube or to said second throttle capillary tube in a fluidically conducting manner.

12. The refrigeration appliance according to claim 8, wherein said valve facility is embodied to interrupt a flow from said intermediate capillary tube into said throttle capillary tube.

13. The refrigeration appliance according to claim 11, wherein said valve facility is a rotary valve embodied to separate said intermediate capillary tube fluidically from said first and said second throttle capillary tube, and to connect to said first throttle capillary tube or to said second throttle capillary tube in a fluidically conducting manner.

14. The refrigeration appliance according to claim 11, wherein said valve facility has a non-return valve and a distributor valve connected in series herewith, wherein said non-return valve is embodied to separate said intermediate capillary tube fluidically from said first and said second throttle capillary tube, and wherein said distributor valve is embodied to connect said intermediate capillary tube to said first throttle capillary tube or to said second throttle capillary tube in a fluidically conducting manner.

15. A refrigeration appliance, comprising:

at least one refrigeration compartment for receiving refrigerated goods;

a refrigerant circuit, containing:

a condenser;

an evaporator coupled thermally to said at least one refrigeration compartment for cooling said at least one refrigeration compartment, said evaporator being connected to said condenser;

a dryer disposed between said condenser and said evaporator;

a throttle capillary tube;

an intermediate capillary tube; and a valve facility being connected to said dryer by means of said intermediate capillary tube and to said evaporator by means of said throttle capillary tube; and an intermediate piece;

said dryer having an output connected to said intermediate piece;

said valve facility having an input; and said intermediate capillary tube running uninterrupted between said intermediate piece and said input of said valve facility.

16. A refrigeration appliance, comprising:

at least one refrigeration compartment for receiving refrigerated goods;

a refrigerant circuit, containing:

a condenser;

an evaporator coupled thermally to said at least one refrigeration compartment for cooling said at least one refrigeration compartment, said evaporator being connected to said condenser;

a dryer disposed between said condenser and said evaporator;

a throttle capillary tube;

an intermediate capillary tube; and a valve facility being connected to said dryer by means of said intermediate capillary tube and to said evaporator by means of said throttle capillary tube; and an intermediate piece;

said dryer having an output connected to said intermediate piece; and said intermediate piece is an evacuation tube.

* * * * *